US007213435B2

(12) United States Patent
Huber et al.

(10) Patent No.: US 7,213,435 B2
(45) Date of Patent: May 8, 2007

(54) SPLINED CLUTCH HUB AND METHOD OF MAKING SAME

(75) Inventors: David P. Huber, Millbury, OH (US); Ben R. Vasa, Lapeer, MI (US)

(73) Assignee: Metal Forming & Coining Corporation, Maumee, OH (US)

( * ) Notice: Subject to any disclaimer, the term of this patent is extended or adjusted under 35 U.S.C. 154(b) by 0 days.

(21) Appl. No.: 10/512,664

(22) PCT Filed: Jun. 3, 2003

(86) PCT No.: PCT/US03/17509

§ 371 (c)(1),
(2), (4) Date: Oct. 26, 2004

(87) PCT Pub. No.: WO04/001248

PCT Pub. Date: Dec. 31, 2003

(65) Prior Publication Data

US 2005/0126249 A1 Jun. 16, 2005

Related U.S. Application Data

(60) Provisional application No. 60/390,338, filed on Jun. 21, 2002.

(51) Int. Cl.
*B21K 1/30* (2006.01)

(52) U.S. Cl. ..... 72/359; 72/355.4

(58) Field of Classification Search ..... 72/358, 72/355.4, 355.2, 355.8, 354.8, 359, 354.6; 29/893.34

See application file for complete search history.

(56) References Cited

U.S. PATENT DOCUMENTS 6,233,999 B1 * 5/2001 Yabutani et al. ..... 72/354.8

FOREIGN PATENT DOCUMENTS

| | | | |
|---|---|---|---|
| DE | 28 26 639 A1 | | 12/1979 |
| JP | 01258840 A | * | 10/1989 |
| JP | 6-101722 | | 12/1994 |

* cited by examiner

*Primary Examiner*—Derris H. Banks
*Assistant Examiner*—Debra Wolfe
(74) *Attorney, Agent, or Firm*—Fraser Martin & Miller LLC; Donald R. Fraser

(57) ABSTRACT

An externally splined clutch hub and method for making the same is disclosed wherein a flat circular metal preform with a central opening is provided and contacted with a single forging die to simultaneously cold forge a centrally disposed tubular neck extending outwardly from one side of the preform and simultaneously a splined annular ring at the periphery of the preform and extending outwardly from the other side of the preform wherein the tubular neck and the annular ring are coaxial.

9 Claims, 4 Drawing Sheets

SPLINED CLUTCH HUB AND METHOD OF MAKING SAME

This application is a continuation of U.S. provisional patent application Ser. No. 60/390,338, filed Jun. 21, 2002.

BACKGROUND OF THE INVENTION

1. Field of the Invention

The invention relates to a low cost, externally splined clutch hub and a process for making the same.

2. Description of the Prior Art

Currently externally splined clutch hubs are produced by a roll forming process from tubular preforms. The process requires the use of tubes formed of very high quality low carbon steel. These tubes are expensive and currently are available from one overseas source. The roll forming process typically exerts severe loads on the tools and the associated machinery. Process downtime is a frequent occurrence.

An alternate process for producing externally splined clutch hubs is a progressive stamping process. In the progressive stamping process, a strip of sheet metal, or individual disks of steel, are transferred along a multiple station-stamping tool. These multiple stations progressively change the shape of the workpiece by stretching and drawing the material to achieve the final shape. The process requires very expensive tools and associated machines.

BRIEF SUMMARY OF THE INVENTION

It is an object of the invention to produce a process for producing a cold forged externally splined clutch hub.

Another object of the invention is to produce a cold forged externally splined clutch hub which is economical and may be readily reproduced.

Still another object of the invention is to produce an entire externally splined clutch hub in a single cold forging step.

BRIEF DESCRIPTION OF THE SEVERAL VIEWS OF THE DRAWINGS

The objects and advantages of the invention will become readily apparent to those skilled in the art from reading the following detailed description of the invention when considered in the light of the accompanying illustrations, in which.

DETAILED DESCRIPTION OF THE INVENTION

Figure 2:
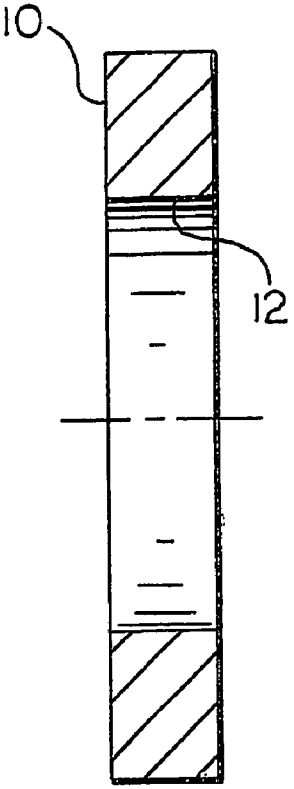
FIG. 2 is a sectional view of the blank illustrated in FIG. 1 taken along line 2—2 thereof.
Figure 1:
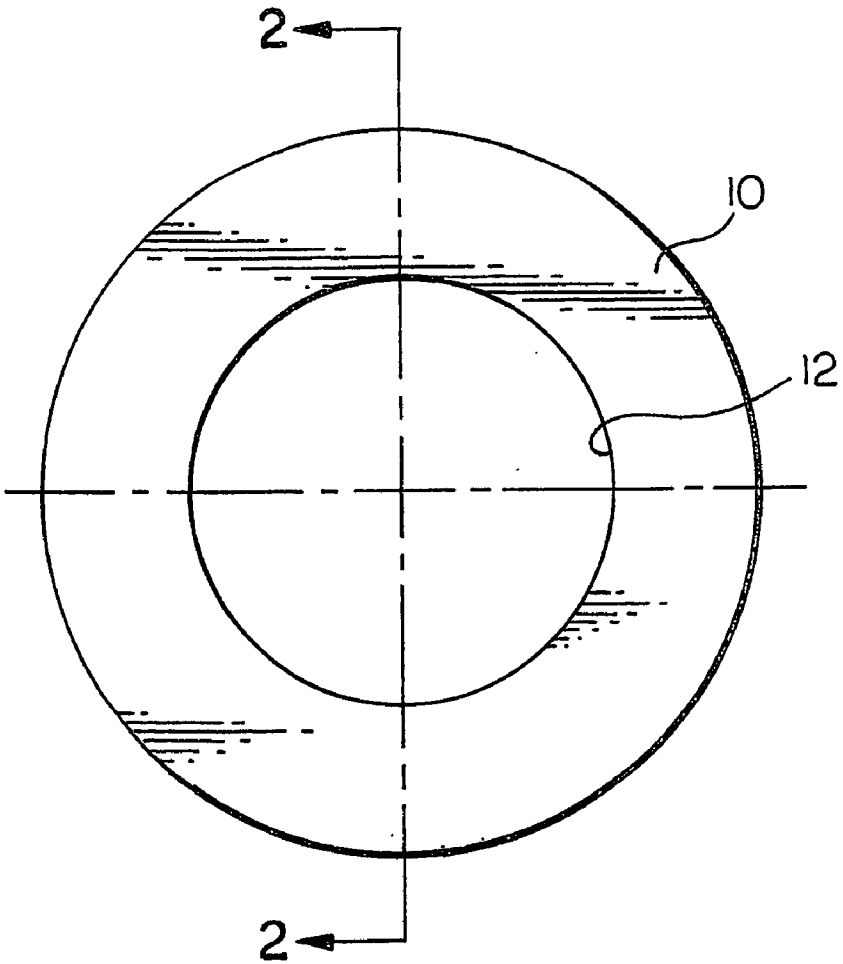
FIG. 1 is a top plan view of a metal blank from which the externally splined clutch hub of the invention is formed.
Figure 3:
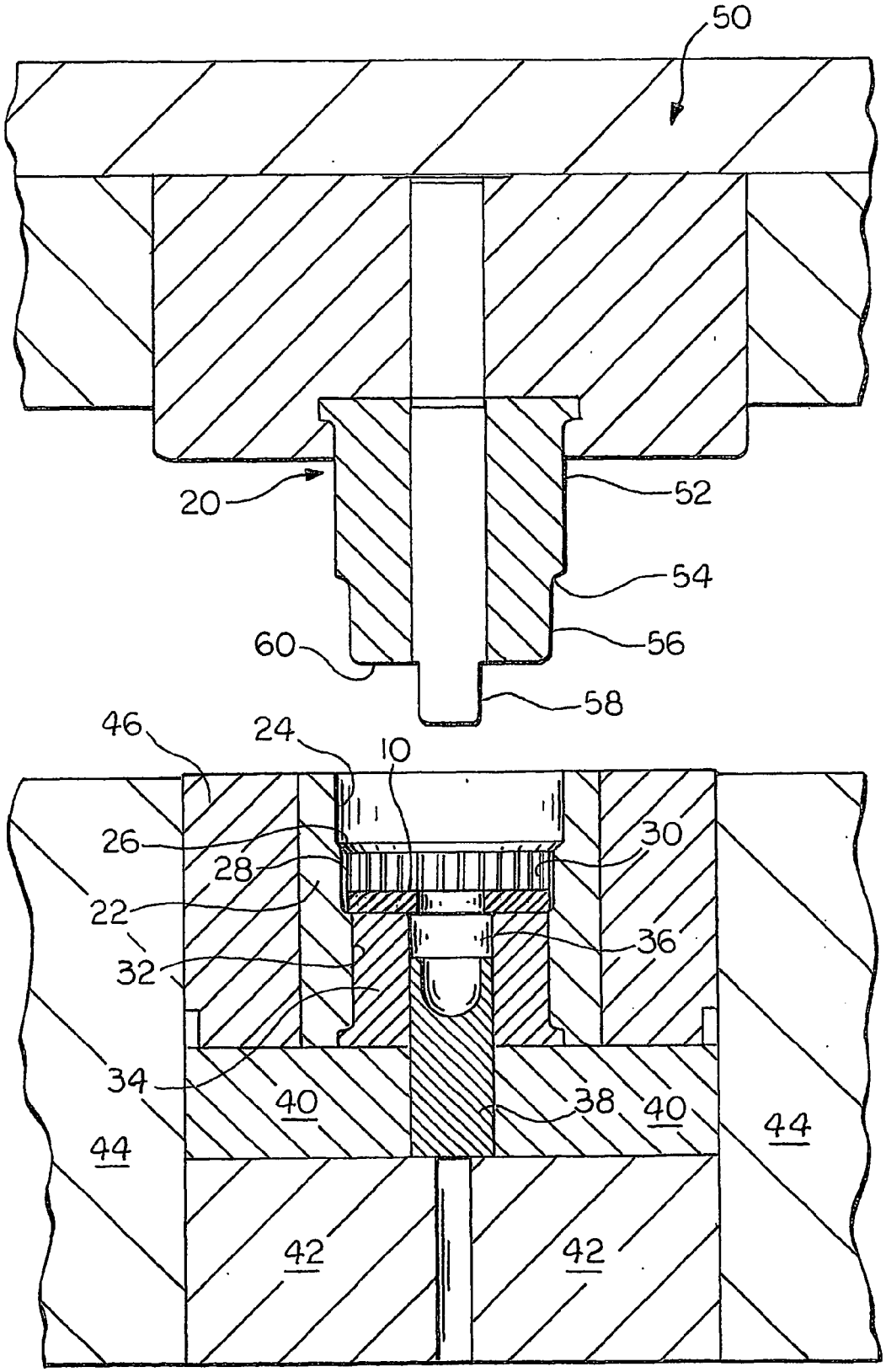
FIG. 3 is a fragmentary view partly in section illustrating the position of the blank illustrated in FIGS. 1 and 2 in associated tooling wherein the cooperating punch and die members are separated preparatory to the operative forming stages.
Figure 4:
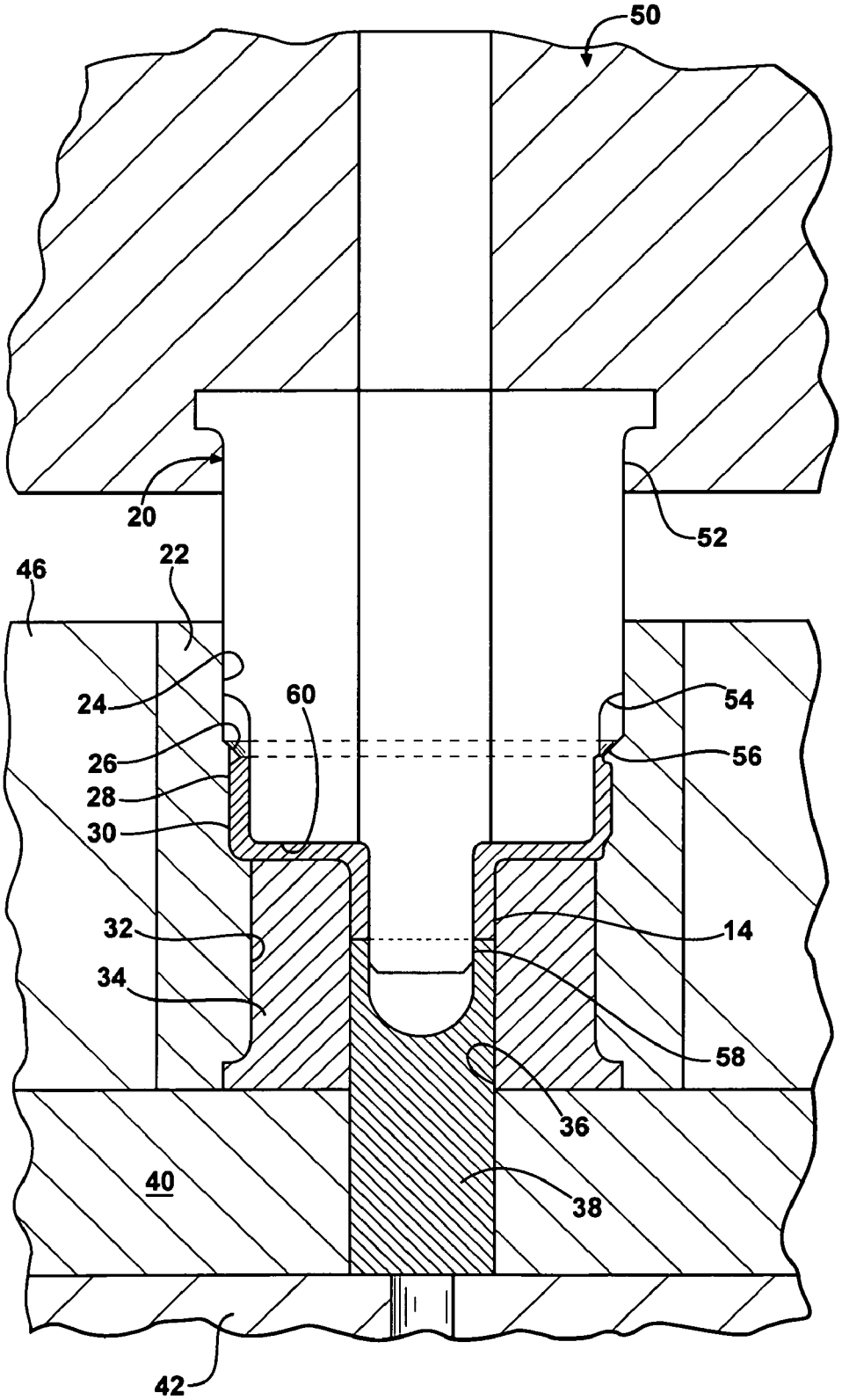
FIG. 4 is a fragmentary view similar to FIG. 3 showing the tooling after the punch has been driven into the die to cold forge the externally splined clutch hub of the invention.

Referring to the drawings, the preferred process requires a flat circular metal workpiece or preform 10 as clearly illustrated in FIGS. 1 and 2. Typically, the preform 10 is formed by a stamping operation and is robust enough to accept standard variations within steel grades. The preform 10 is in the form of a flat circular metal workpiece with a centrally disposed opening 12. As illustrated in FIGS. 3 and 4, a single forging die set is comprised of an upper die or punch 20 and a lower die 22. The dies 20 and 22 cooperate to cause the metal adjacent the central opening 12 of the preform to flow in one direction to form a tubular neck 14 extending from one surface of the preform 10, as more clearly shown in FIGS. 5 and 6. Simultaneously, the forging die set causes the metal of the preform 10 adjacent the peripheral circumference to flow outwardly to form a depending ring 16 having radially outwardly extending splines 18 extending from the opposite surface of the preform 10. The tubular neck 14 and the splined ring 16 of the finished splined clutch hub are coaxial with one another as illustrated in FIGS. 3, 4, 5 and 6. Tooling is reduced to a single forging die set, with the possible addition of one set of calibrating tools. The simplified tooling can be run on less expensive equipment than the progressive stamping process, resulting in cost improvements in machine maintenance as well as in tooling maintenance.

In the production of the splined clutch hub of the invention, the preform 10 is typically initially lubricated in preparation for the cold forging operation. The lubrication may be a phosphorous compound in combination with a soap as well known in the art. The lubricated preform 10 is then placed in the lower die 22 of the die set. The lower die 22 is generally cylindrical in shape and is provided with a centrally formed coaxial interior wall 24 which terminates in an inwardly extending beveled annular shoulder 26 and thence a cylindrical section 28 having an inwardly extending array of spaced apart parallel splines 30.

The lower die 22 is finally provided with a lowermost cylindrical wall 32 for receiving a lower die insert 34. The lower die insert 34 is provided with a coaxially formed cylindrical wall 36 for receiving the upper portion of a cylindrically shaped stool 38. The lower portion of the stool 38 is typically received within a cylindrical opening within a backup member 40 which rests upon the upper surface of a cooperating backup member 42. The backup members 40 and 42 cooperate to determine the vertical positioning of the lower die 22 within the lower die shoe 44.

The operating portion of the lower die 22 which is comprised of the lower die 22 and the lower die insert 34. These die members are typically tightly secured within an outer shrink ring 46. In assembling the lower die 22 and the lower die insert 34 into an integral unit, the shrink ring 46 is formed of a metal which when heated will expand a degree sufficient to receive the assembled lower die 22 and the lower die insert 34. Once the lower die 22 and lower die insert 34 are satisfactorily received within the heated and expanded shrink ring 46, the shrink ring 46 is allowed to cool and thereby shrink to tightly and securely hold the lower die 22 and the lower die insert 34 therewithin. The assemblage is then inserted into the lower die shoe 44 preparatory to the placement of the preform 10 within the assemblage as illustrated in FIG. 3.

The punch or upper die member 20 is attached to a press 50 in a manner well known in the art. The punch or upper die member 20 is comprised of a cylindrical body portion having an outer wall configuration 52 which is often referred to as a pilot diameter. The wall 52 initially contracts the inner wall 24 of the lower die 22 and functions to guide the punch 20 as the press 50 causes the punch 20 to be moved downwardly at the commencement of the forging operation.

The wall 52 terminates in an inwardly inclined shoulder 54 formed with a radius. A cylindrical wall 56 depends from the shoulder 54 and is of a diameter less than the diameter of the cylindrical wall 52.

The lowermost end of the punch 20 is formed with a depending cylindrical wall 58 which is receivable within the cylindrical wall 36 of the lower die insert 34.

Figure 6:
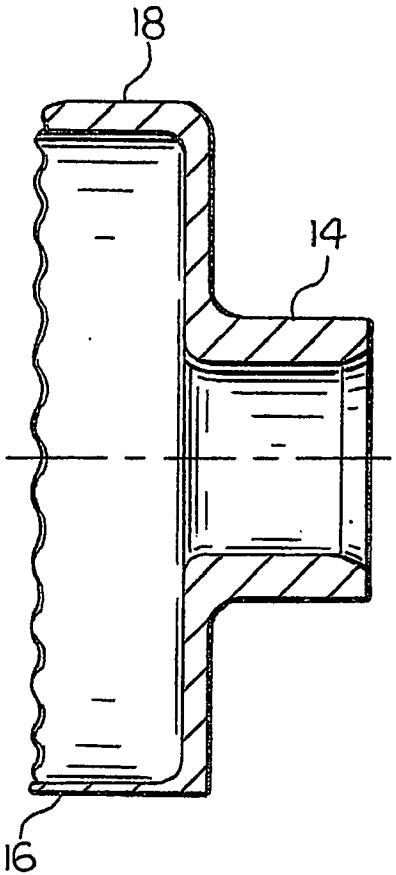
FIG. 6 is a cross sectional view of the hub Illustrated in FIG. 5 taken along line 6—6 thereof.
Figure 5:
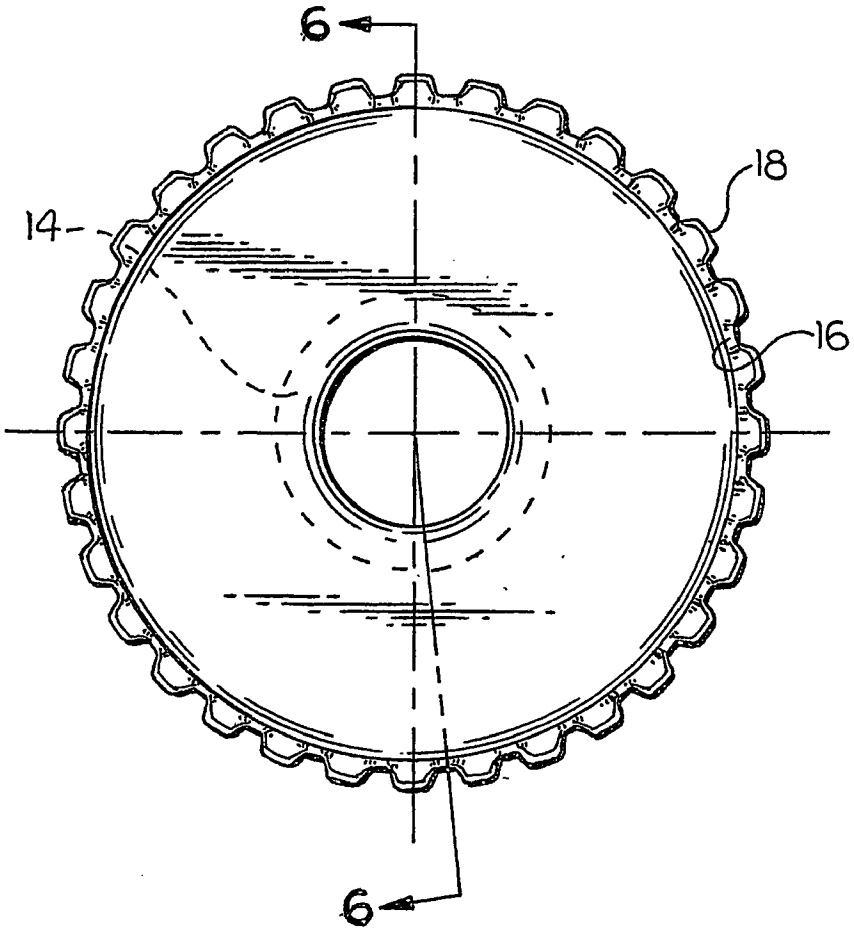
FIG. 5 is a top plan view of the externally splined clutch hub produced in accordance with the tooling illustrated in FIGS. 3 and 4.

Continuing with the description of the operation, it will be appreciated that as the press 50 forces the punch 20 downwardly, the punch 20 is guided to maintain concentricity by the formation of the lower die member 22 until the lowermost surface 60 and the wall 58 of the punch 20 contact the preform 10 causing the metal of the preform adjacent the central opening 12 to flow downwardly to form a tubular neck 14, as illustrated in FIGS. 4 and 6. Simultaneously, the forging die set causes the metal adjacent the peripheral circumference to flow outwardly and upwardly to form a depending ring 16 wherein the outer portion of flow thereof enters the splines 30 of the lower die 22 to form outwardly extending splines 18.

The benefits and advantages of the invention reside in the improved strength due to greater degree of cold working and higher carbon steel; the improved machinability to higher carbon steel; and the improved tolerances due to eliminating springback in the forming process.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A method of making an externally splined clutch hub comprising:

providing a flat circular metal preform with a centrally formed opening; and contacting the preform with a single forging die to simultaneously cold forge a centrally disposed tubular neck extending outwardly from one side of the preform and simultaneously a splined annular ring at the periphery of the preform and extending outwardly from the other side of the preform wherein the tubular neck and the annular ring are coaxial.

2. An apparatus for forming an externally splined clutch hub from cold forging a flat annular preform having a central opening comprising:

a lower die having an upper inner cylindrical wall with an annular array of splines, a lower inner cylindrical wall, and an inter-connecting shoulder for receiving a cooperating punch, and a hollow cylindrical insert for supporting the preform; and an upper punch for reception within the lower die, said punch including a cylindrical outer wall a portion of which is initially received by the upper inner wall of said lower die for maintaining concentricity of said punch and said lower die prior to and during formation of the preform.

3. An apparatus as defined in claim 2 wherein the insert of said lower die includes an innermost end.

4. An apparatus as defined in claim 3 wherein the innermost end of the insert terminates in a shoulder.

5. An apparatus as defined in claim 2 wherein the upper cylindrical wall of said lower die is of greater diameter then the diameter of the lower cylindrical wall of said lower die.

6. An apparatus as defined in claim 2 wherein said upper punch is caused to be driven into cooperation with said lower die to cause the metal adjacent the periphery of the central opening of the preform to flow in one direction and the metal adjacent the outer periphery of the preform to flow in an opposite direction.

7. An apparatus as defined in claim 6 wherein the metal flow adjacent the central opening forms a tubular neck portion of the hub and the metal flow adjacent the outer periphery forms an annular depending ring.

8. An apparatus as defined in claim 7 wherein the annular depending ring contains an array of parallel spaced apart splines.

9. An apparatus as defined in claim 7 wherein the tubular neck and the annular depending ring are coaxial.

* * * * *